US007121853B1

(12) United States Patent
Gast

(10) Patent No.: US 7,121,853 B1
(45) Date of Patent: Oct. 17, 2006

(54) LOCKING DEVICE FOR ELECTRICAL PLUGS AND ELECTRICAL OUTLETS

(76) Inventor: James C. Gast, 340 Deer Point Dr., Gulf Breeze, FL (US) 32561

( * ) Notice: Subject to any disclaimer, the term of this patent is extended or adjusted under 35 U.S.C. 154(b) by 0 days.

(21) Appl. No.: 11/356,237

(22) Filed: Feb. 17, 2006

Related U.S. Application Data

(60) Provisional application No. 60/740,268, filed on Nov. 29, 2005.

(51) Int. Cl.
*H01R 13/44* (2006.01)

(52) U.S. Cl. ..... 439/134; 70/53

(58) Field of Classification Search ..... 439/134, 439/133, 135; 70/53, 57
See application file for complete search history.

(56) References Cited

U.S. PATENT DOCUMENTS

| | | | | | |
|---|---|---|---|---|---|
| 1,527,424 | A | * | 2/1925 | May | 362/353 |
| 3,543,544 | A | * | 12/1970 | Efston | 439/134 |
| 4,080,029 | A | | 3/1978 | St. Fort | |
| 4,932,874 | A | * | 6/1990 | Hollopeter et al. | 439/133 |
| 4,969,833 | A | | 11/1990 | Lindow | |
| 5,071,360 | A | | 12/1991 | Lindow | |
| 5,113,311 | A | * | 5/1992 | Kamp et al. | 361/327 |
| 5,169,326 | A | * | 12/1992 | Werner | 439/134 |
| D338,446 | S | | 8/1993 | Werner | |
| 5,288,239 | A | | 2/1994 | Johnson | |
| 5,791,931 | A | | 8/1998 | Burkhart | |
| D477,525 | S | | 7/2003 | Ling | |
| 6,652,307 | B1 | | 11/2003 | Tatz | |
| 6,675,614 | B1 | | 1/2004 | Lai | |
| D492,185 | S | | 6/2004 | Maurer | |
| 6,799,981 | B1 | | 10/2004 | Yu | |
| 6,935,871 | B1 | | 8/2005 | Maurer | |
| 6,997,724 | B1 | * | 2/2006 | Earl | 439/133 |
| 2004/0224543 | A1 | | 11/2004 | Maurer | |

FOREIGN PATENT DOCUMENTS

| | | |
|---|---|---|
| DE | 3304727 | 8/1994 |

* cited by examiner

*Primary Examiner*—Michael C. Zarroli
(74) *Attorney, Agent, or Firm*—Richard C. Litman

(57) ABSTRACT

The locking device for electrical plugs includes a housing for receiving the prongs of at least one electrical plug therein. The distal end of a rod is pivotally secured to the inner face of a rear wall of the housing, with the rod being received by holes formed in the prongs of the electrical plug. A support is mounted to the front exterior face of the housing and has a channel formed in its upper surface. The front face further has an opening formed therethrough for receiving the proximal end of the rod, which is further releasably received within the channel. A lock is mounted to the support for selectively and releasably locking the rod within the channel, thusly releasably locking the prongs to the rod within the housing. The locking device allows the prongs of electrical plugs to be secured within the housing in order to prevent theft and, further, as a safety precaution.

12 Claims, 10 Drawing Sheets

LOCKING DEVICE FOR ELECTRICAL PLUGS AND ELECTRICAL OUTLETS

CROSS-REFERENCE TO RELATED APPLICATION

This application claims the benefit of U.S. Provisional Patent Application Ser. No. 60/740,268, filed on Nov. 29, 2005.

BACKGROUND OF THE INVENTION

1. Field of the Invention

The present invention relates to safety and protective devices for electrical plugs, and particularly to a locking device for electrical plugs in order to prevent unauthorized taking or use of the appliance or device to which the plug is attached, e.g., by thieves, vandals, children, etc.

2. Description of the Related Art

Power tools, electrical appliances and the like are generally specialized and expensive articles, thus making them desirable targets for thieves. Portable items, such as power tools, are particularly likely to be stolen, due to their size and portable natures. Thus, in order to protect the tools from theft, a locking device of some sort must be employed in order to prevent theft, but still allow authorized users to remove the tools from their secure locations. Further, such tools, appliances and similar articles are also vulnerable to use by unauthorized users, such as those without proper safety training or children. In order to prevent theft and unauthorized use, locking devices that engage the prongs of the power cord have been utilized.

Some such locking devices include locking caps, which fit over individual plug heads, covering the prongs and thus preventing the prongs from being plugged into electrical sockets. Such devices, however, are generally only suitable for covering a single plug and, due to their small size, would not present a great deterrent to theft. Larger locking devices often include a long rod provided within a housing for engaging the holes formed in power cord prongs. In order to release the power cords, the rod is removed from the housing. Although such devices offer protection from theft and unauthorized users, the lock, the rod and the housing must all be separated in order to release the power cords. These parts can easily become separated, lost or misaligned, thus preventing the system from being effective in theft prevention and safety promotion. Further, removing the rod from the housing requires freeing all of the plugs at once, even if the user only desires to remove a single plug. Thus, a locking device for electrical plugs solving the aforementioned problems is desired.

SUMMARY OF THE INVENTION

The locking device for electrical plugs includes an open housing for receiving the prongs of at least one electrical plug therein. An upper opening is formed through an upper wall of the housing for receiving the prongs. The distal end of a rod is pivotally secured to the inner face of a rear wall of the housing, with the rod being received by holes formed through the prongs of the at least one electrical plug.

A support is mounted to the front exterior face of the housing and has a channel formed in its upper surface. The front face further has an opening formed therethrough for receiving the proximal end of the rod, which is releasably received within the channel. The opening formed through the front face extends from the channel to the upper opening, allowing the rod to pivot upwardly for reception and removal of the prongs thereon.

A lock is mounted to the support for selectively and releasably locking the rod within the channel, thusly releasably locking the prongs to the rod within the housing. The support includes a plurality of projecting members formed on a lower surface thereof for engaging the lock. The locking device allows the prongs of electrical plugs to be secured within the housing in order to prevent theft and, further, as a safety precaution.

A locking device for an electrical outlet is further provided, having a housing and a releasable cover. The housing is adapted for mounting on a support surface, such as a wall, surrounding an electrical outlet. The housing has a support mounted on a lower wall thereof, with the support having a channel formed therein. The cover has a rod mounted on a lower edge thereof for releasable reception within the channel when the cover is mounted on the housing. A lock selectively and releasably covers the support and the rod, thus selectively and releasably securing the cover to the housing and preventing unauthorized access to the electrical outlet.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
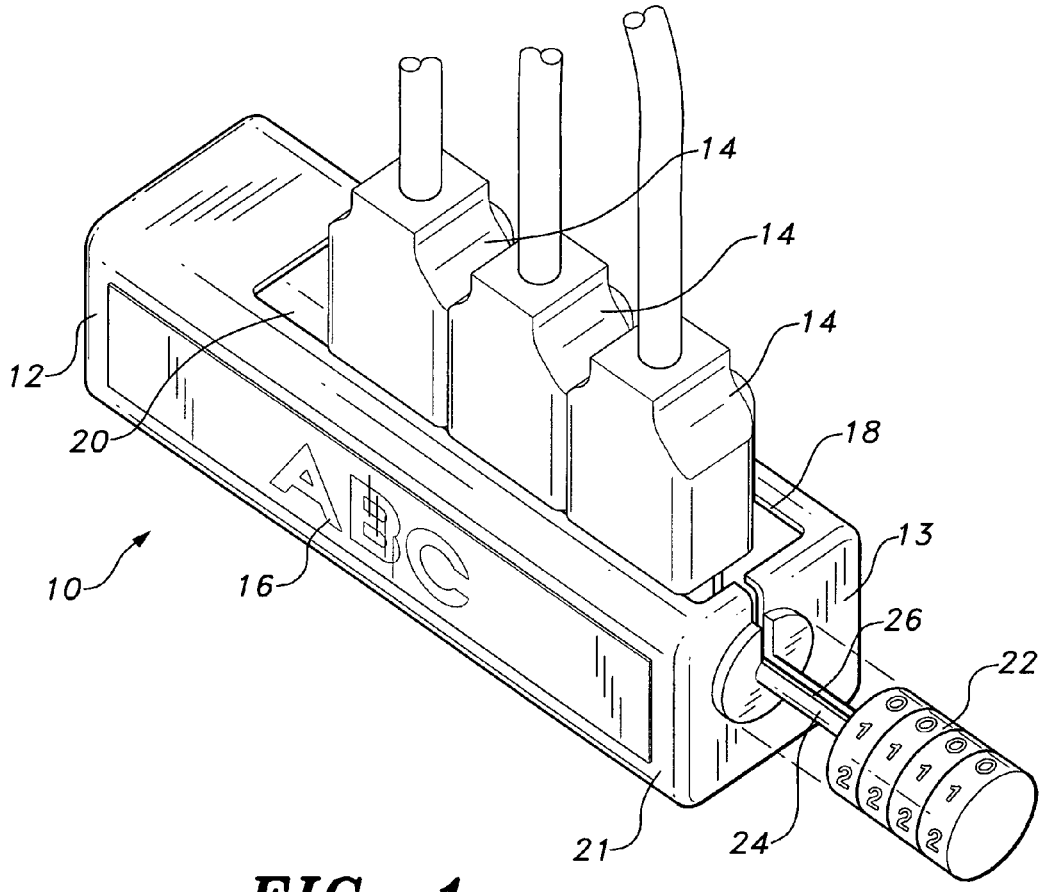
FIG. 1 is an environmental perspective view of a locking device for electrical plugs according to the present invention.
Figure 2:
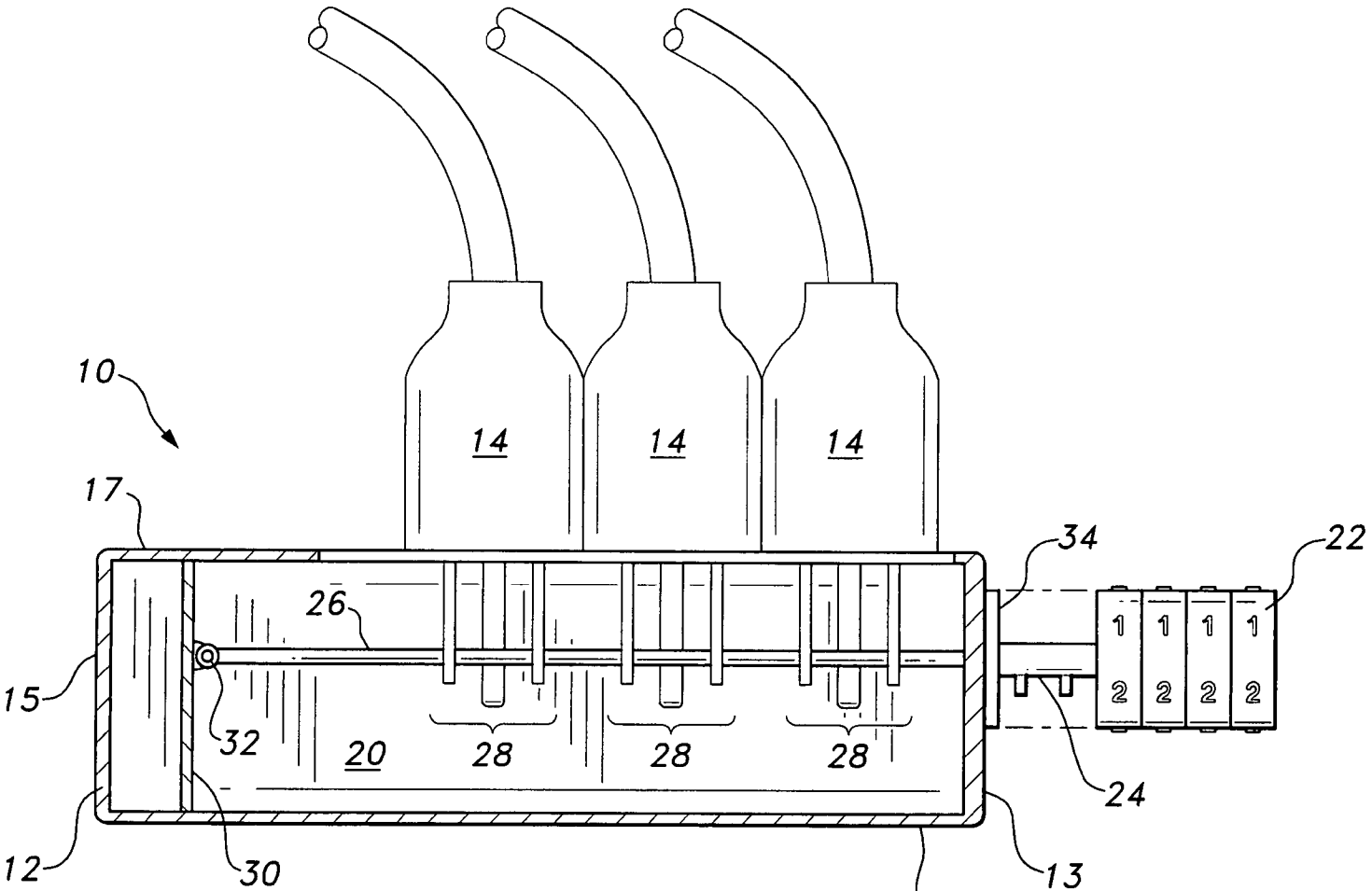
FIG. 2 is an environmental side elevation view in section of the locking device for electrical plugs according to the present invention.

A first embodiment of a locking device for electrical plugs, designated generally as 10 in the drawings, is shown in FIGS. 1–5. As shown in FIGS. 1 and 2, the locking device for electrical plugs 10 includes an open housing 12 and a rod 26. Rod 26 is pivotally secured at a distal end thereof to an interior wall of housing 12, as will be described in further detail below. The rod 26 is received by holes formed through the prongs 28 of at least one electrical plug 14, thus securing the prongs 28 within the housing 12. As will be described in greater detail below, a proximal end of the rod 26 is releasably locked to a support 24 by a user-actuated lock 22, thus selectively and releasably locking the prongs 28 of the plugs 14 within the housing 12. Though shown as being used with three plugs 14 in the Figures, it should be understood that this is for exemplary purposes only, and device 10 may be utilized with any desired number of plugs 14. The selective and releasable securement of prongs 28 within housing 12 deters theft of the electrical devices connected to plugs 14, and further prevents use of the devices by unauthorized users.

As shown in FIGS. 1–5, housing 12 includes upper wall 17, lower wall 19, front wall 13, rear wall 15, and a pair of opposed sidewalls 21. Though illustrated as having a substantially box-like structure, it should be understood that the size and shape of housing 12 are dependent upon the needs and desires of the user. Housing 12 may be formed from plastic, and may further include indicia 16 printed on an exterior surface thereof. Indicia 16 are user-selectable and may be, for example, a trademark or trade name.

An upper opening 18 is formed through upper wall 17, providing access to interior region 20. As best shown in FIG. 2, in the locked configuration of device 10, prongs 28 of plugs 14 are received within interior region 20 of housing 12. Prongs 28 are held within housing 12 through reception of rod 26 through holes formed through each of the prongs 28. The size of rod 26 and the materials used in the manufacture of rod 26 are dependent upon the needs and desires of the user. However, in the preferred embodiment, rod 26 has a diameter of approximately 7⁄64 of an inch, and is formed of hardened steel or stainless steel.

Figure 3:
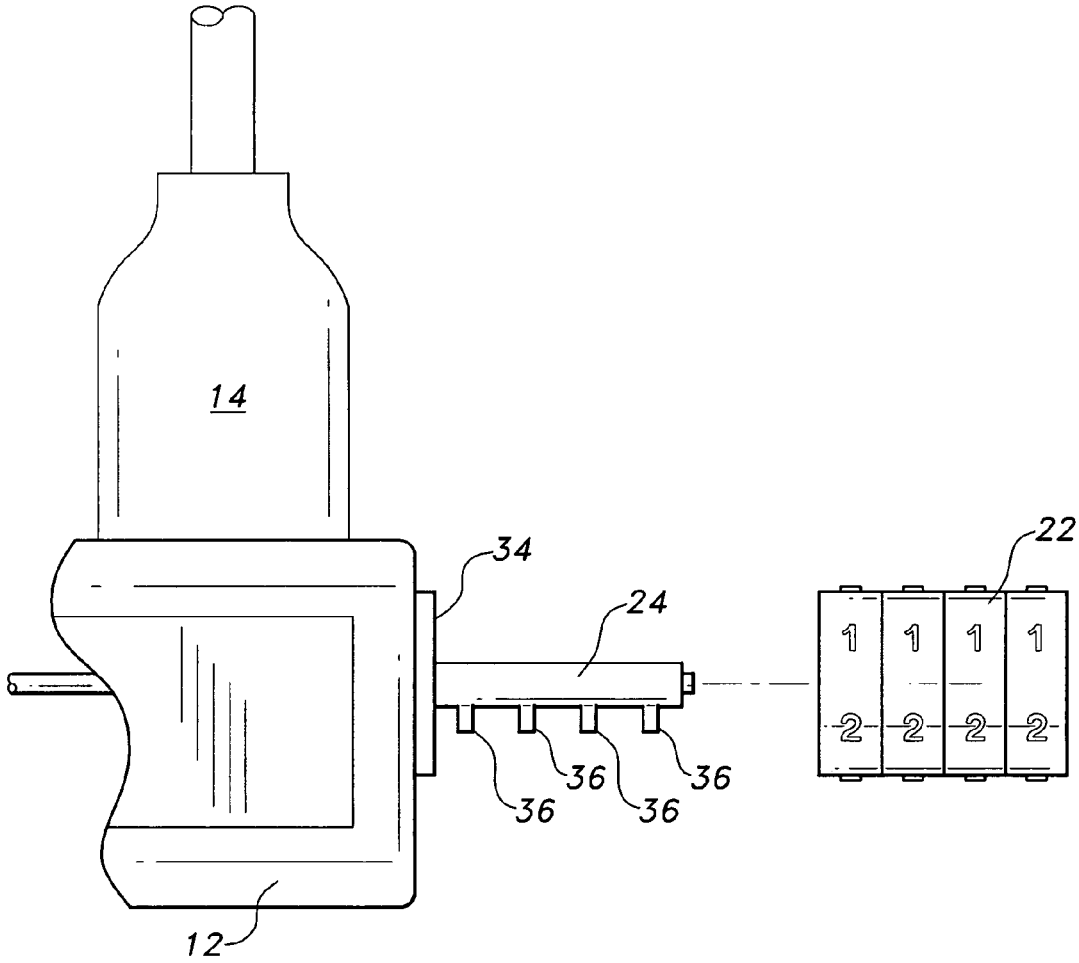
FIG. 3 is an environmental partial side view of the locking device for electrical plugs according to the present invention, illustrating the attachment of a lock on a support.

The distal end of rod 26 is pivotally secured to the interior surface 30 of rear wall 15 by a pivotal securement element 32, which may be a pivot pin or the like. The proximal end of rod 26 is received within a channel formed in support 24. As best shown in FIG. 3, support 24 is mounted to front wall 13 and projects forwardly therefrom. A mounting plate 34 may be additionally mounted to front wall 13, as shown, for providing further structural integrity for support 24. As shown in the front view of FIG. 4, support 24 has a substantially U-shaped contour, with the upper surface of support 24 defining a radial channel or slot for receiving rod 26 therein.

A plurality of engagement members 36 are formed on the lower surface of support 24 and project downwardly therefrom. Lock 22 is received on support 24 and engages engagement members 36 in order to releasably lock rod 26 within the channel defined in support 24. Lock 22 may be any suitable locking device for releasably and selectively locking rod 26 to support 24. However, in the preferred embodiment, lock 22 is a cylindrical combination tumbler-type lock, as shown. Preferably, the cylindrical combination tumbler-type lock 22 has a user resettable combination, allowing the user to select his or her own combination. If multiple systems 10 are used within a household, the user may choose to set all of the locks 22 to the same combination for convenience.

Figure 4:
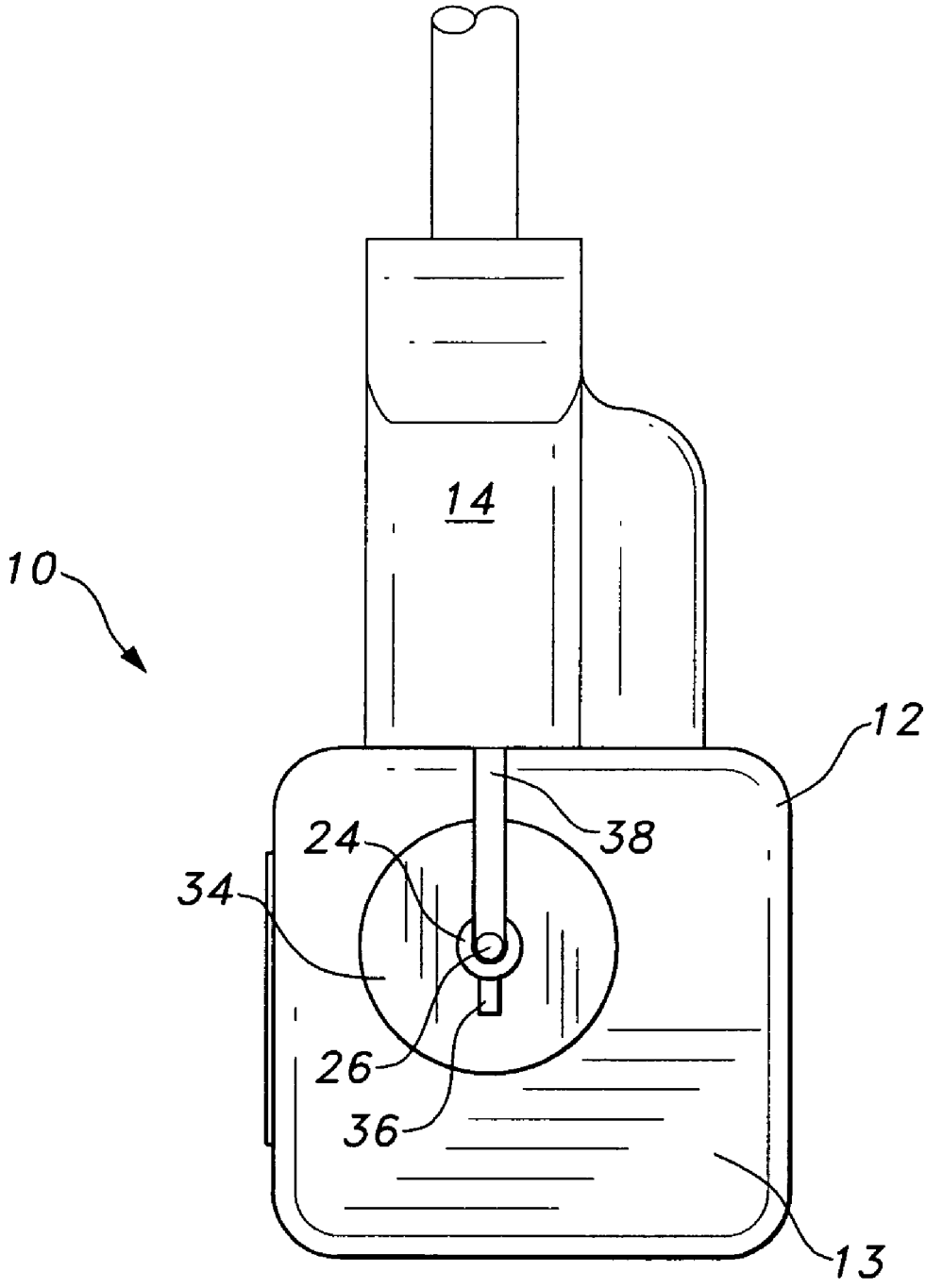
FIG. 4 is an environmental front view of the locking device for electrical plugs according to the present invention.
Figure 5:
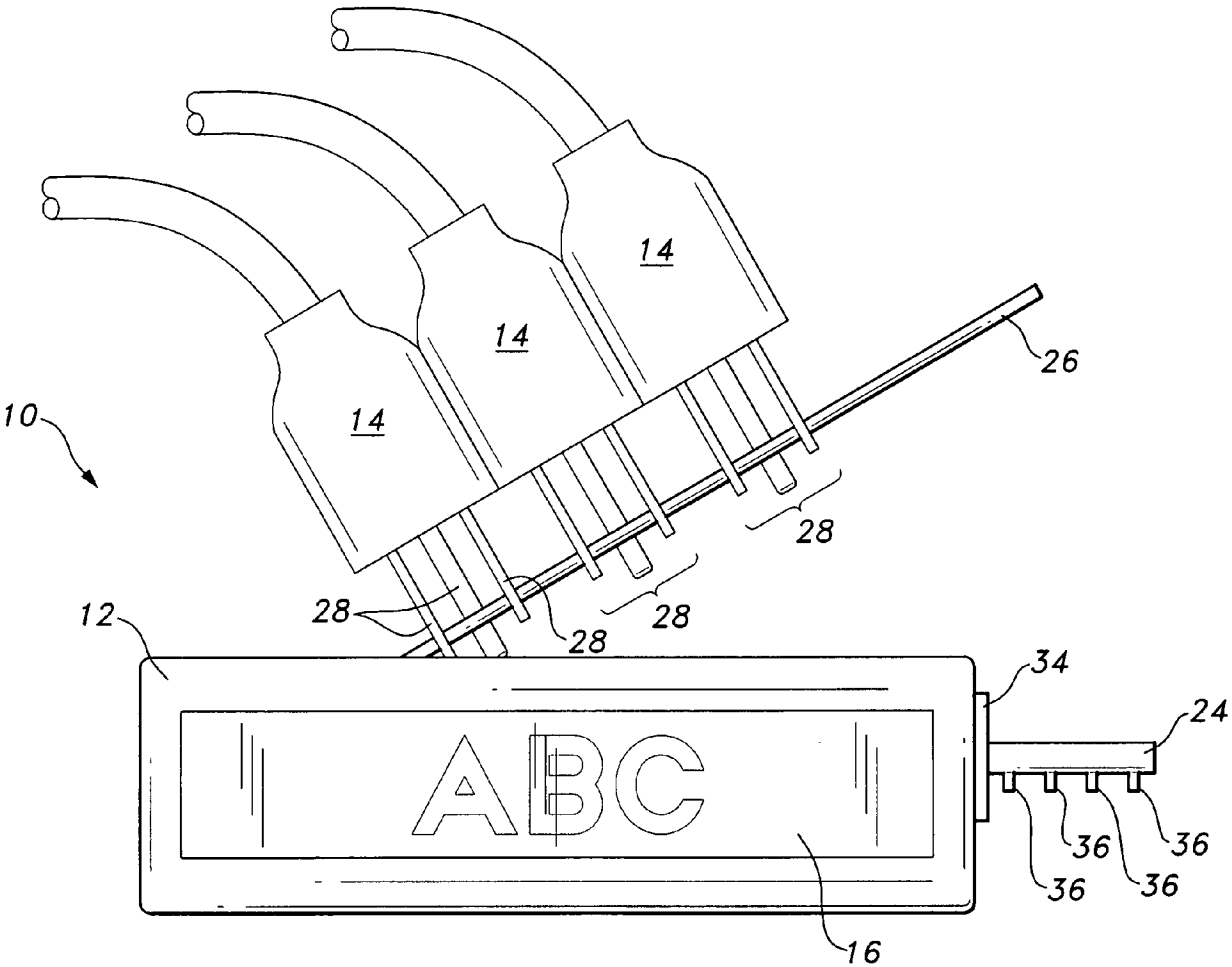
FIG. 5 is an environmental side view of the locking device for electrical plugs according to the present invention in an unlocked configuration.

As best shown in FIG. 4, an opening 38 is formed through front wall 13 and extends between the upper surface of support 24 and the upper edge of front wall 13, connecting to upper opening 18. Rod 26 projects through opening 38 and, as shown in FIG. 5, the proximal end of rod 26 may be pivoted vertically through opening 38 and upper opening 18.

When the user requires access to prongs 28, the user unlocks lock 22 and disengages lock 22 from support 24 and rod 26. Lock 22 may be slid down support 24 to expose rod 26 for removal therefrom. Rod 26 is pivoted about pivotal securement element 32 so that the proximal end of rod 26 passes through opening 38 and upper opening 18 into the angled configuration illustrated in FIG. 5. With the proximal end of rod 26 free, plugs 14 may be removed from rod 26, and the corresponding electrical devices may be utilized by the user. Rod 26 may subsequently be rotated downward so that the proximal end of rod 26 is, once again, seated within the channel of support 24, and lock 22 may be reapplied to support 24 and rod 26. It should be noted that it is not necessary to raise rod 26 completely out of the housing 12, as shown in FIG. 5. The user may selectively limit the angular movement of rod 26 with respect to the housing 12, dependent upon the needs and desires of the user. Further, the lock 22 does not need to be completely removed from the rod 26, as shown in FIG. 3, but may be slidably mounted so that it only needs to be pulled beyond a threshold point in order to release lock 22.

Figure 9:
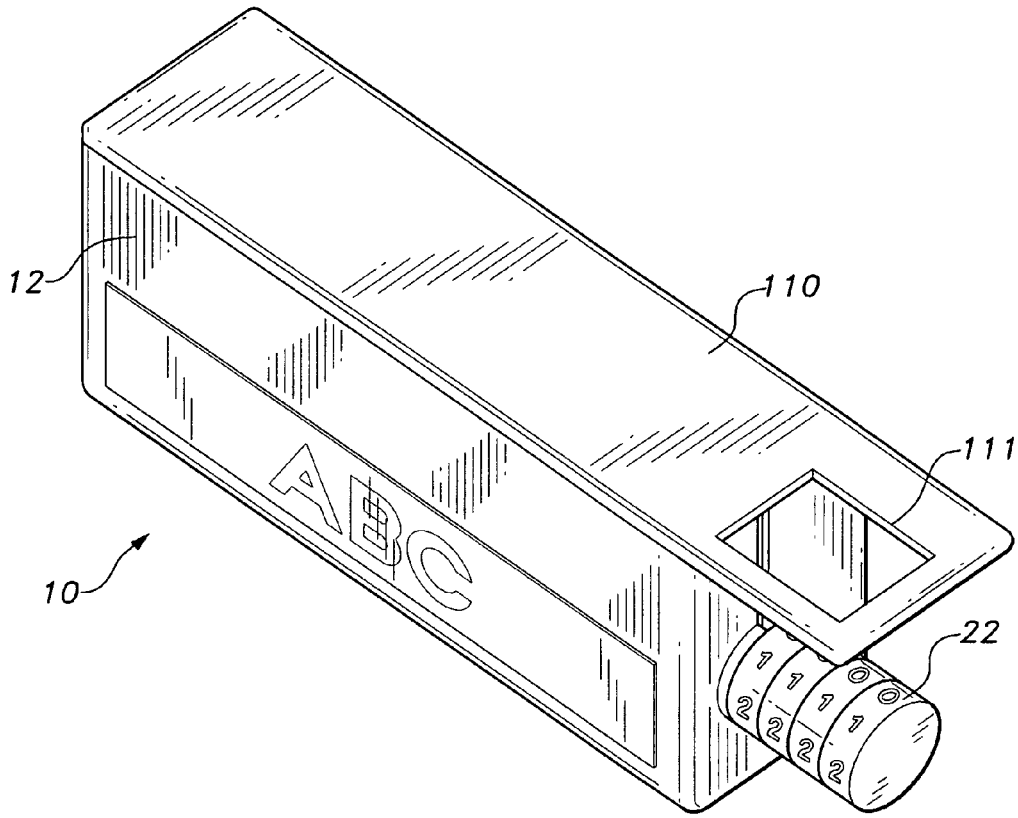
FIG. 9 is a perspective view of an alternative embodiment of the locking device for electrical plugs according to the present invention.

In an alternative embodiment, illustrated in FIG. 9, the locking device for electrical plugs 10 is similar in design to the locking device shown in FIGS. 1–5. However, a cover 110 has been added to prevent unauthorized access to the plugs 14 and the interior of the locking device 10. As shown in FIG. 9, the locking device is substantially similar in design to that shown in FIG. 2, however, front wall 13 and rear wall 15 are extended so that plugs 14 and their associated cords are covered by cover 110. Opening 38, formed in front wall 13 (shown best in FIG. 4), is extended upward and may be widened, if necessary, to accommodate the cords of plugs 14.

Cover 110 is releasably secured to housing 12 through frictional engagement therewith, through the use of releasable fasteners, such as nuts and bolts, through the use of a pivotal connection, such as a hinge, or by any other suitable releasable fastener or attachment means. When cover 110 is in place, additional protection is provided for plugs 14 and for the interior of locking device 10.

Further, as shown in FIG. 9, a cover 110 may be mounted on housing 12, as described above, but may have an extended length such that an overhanging region is formed above the combination lock 22. An opening 111 is formed through cover 110, as shown, providing the user with access to the lock 22, but otherwise protecting the combination lock 22 from inadvertent damage.

Figure 10:
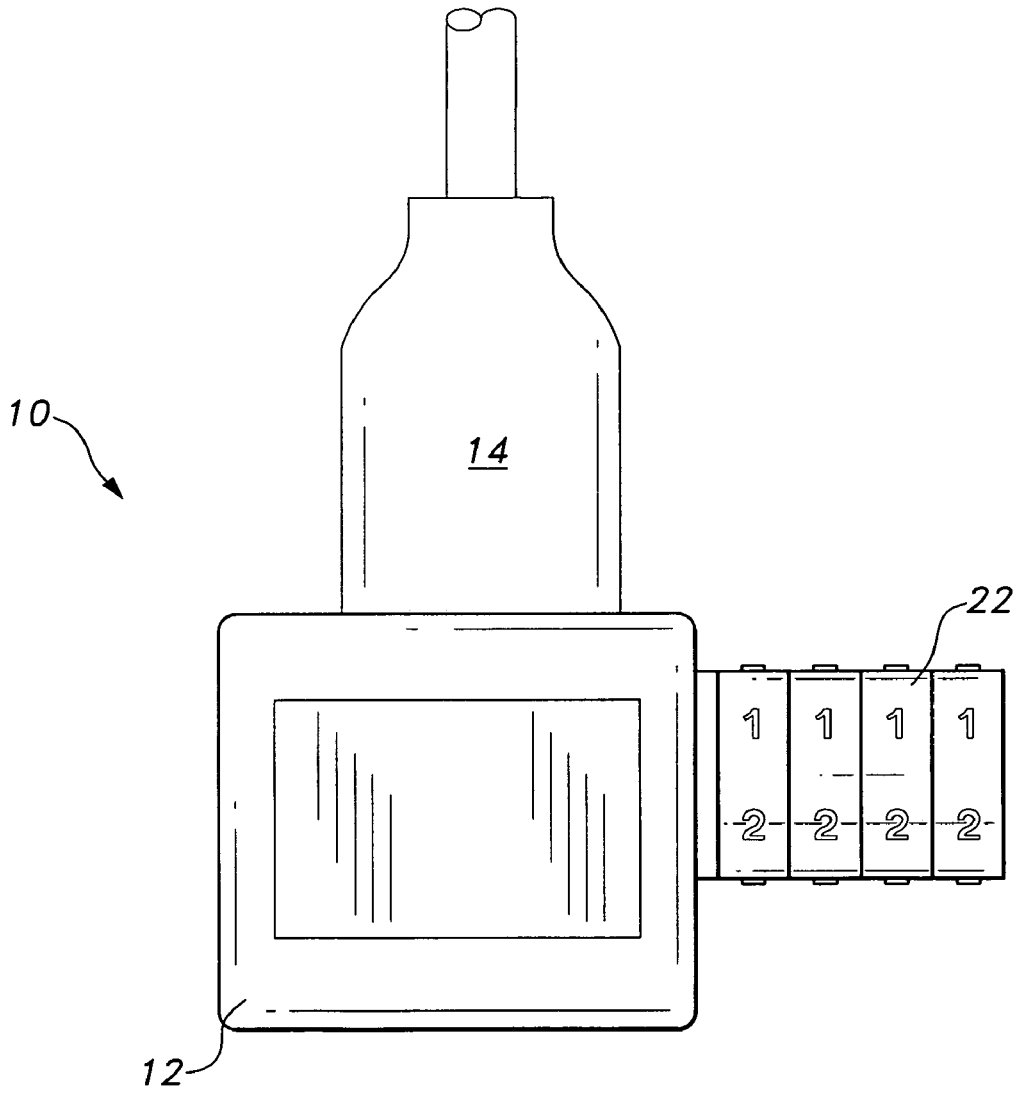
FIG. 10 is a side view of another alternative embodiment of the locking device for electrical plugs according to the present invention.

The dimensions of the locking devices illustrated in FIGS. 1–5 and FIG. 9 are dependent upon the needs of the user. Though FIG. 1, for example, illustrates the locking device 10 being sized and contoured for receiving three plugs 14, the locking devices 10 may be sized and contoured for reception of any desired number of plugs, and any type of electrical plugs. FIG. 10 illustrates an alternative locking device 10 that is similar in structure to locking device 10 of FIGS. 1–5. However, the device 10 of FIG. 10 is sized and contoured to receive a single plug 14. Such a configuration would be desirable for selectively blocking access to an electrical device, such as a power tool, which is portable. The locking device 10 in FIG. 10 could be easily transported with the tool. Locking device 10 further acts as a deterrent to theft. Although this embodiment is portable, the power tool associated with locking device 10 would be unusable except by a user who possesses the correct combination to the locking device.

Figure 6:
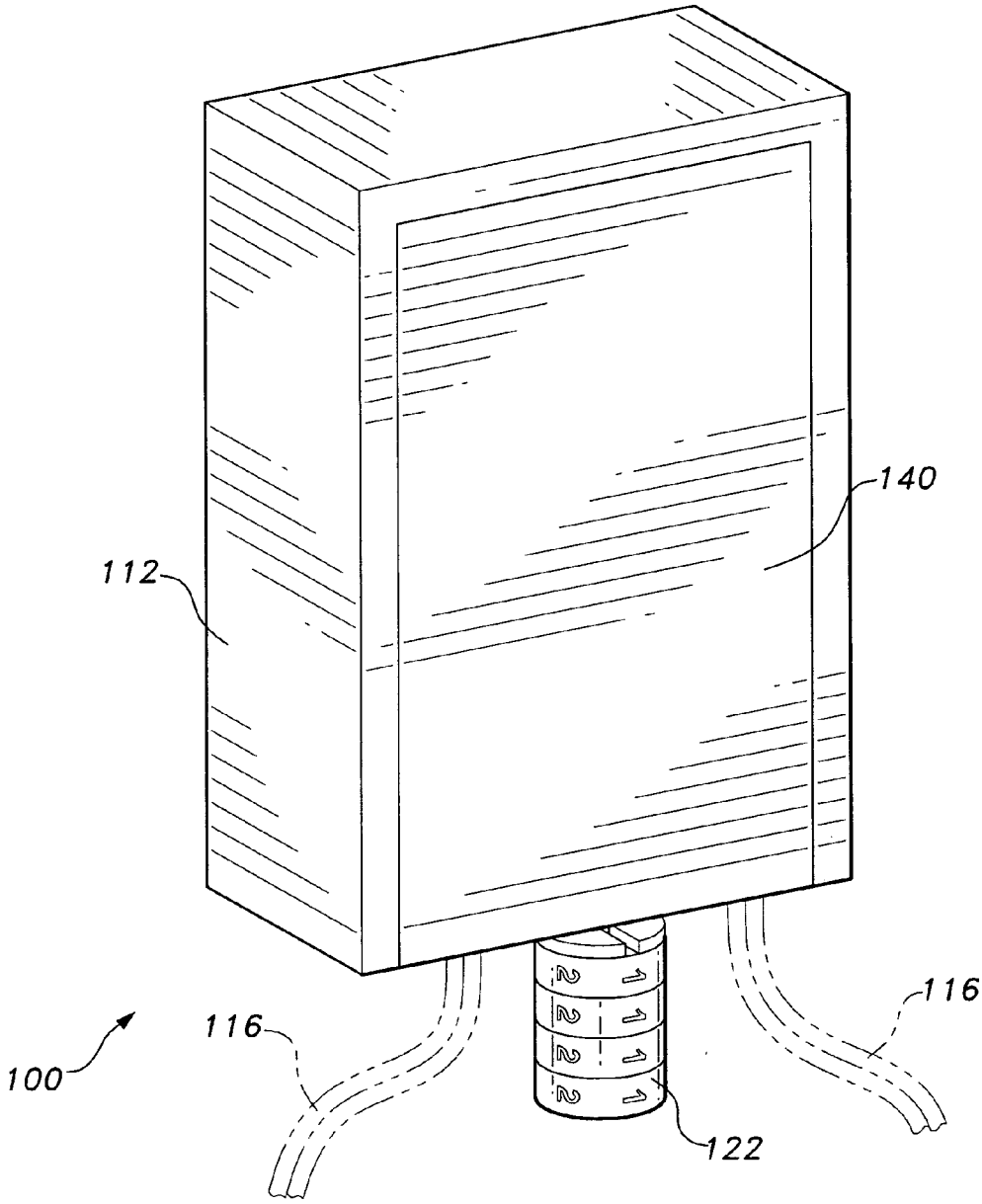
FIG. 6 is an environmental, perspective view of an alternative embodiment of a locking device for electrical outlets according to the present invention.
Figure 7:
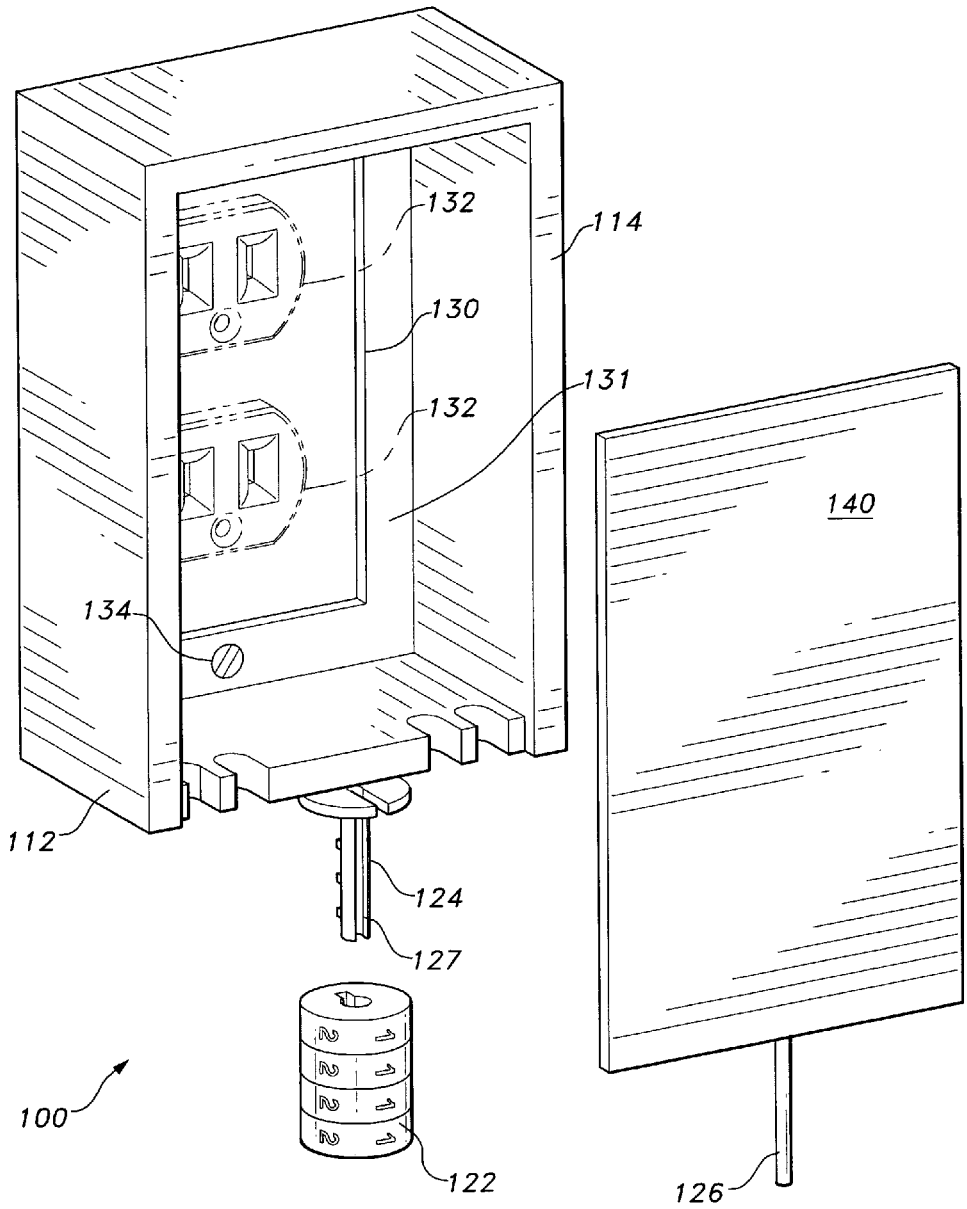
FIG. 7 is a partially exploded perspective view of the locking device for electrical outlets of FIG. 6.

In another alternative embodiment, illustrated in FIG. 6, a locking device for electrical outlets 100 is provided. The locking device 100 includes a housing 112, which is shaped and contoured for mounting on a wall or other surface surrounding an electrical outlet 132 (as best shown in FIG. 7). The housing 112 may be formed from metal or any other suitable material that would prevent unauthorized access to the electrical outlet 132.

As will be described in further detail below, a cover 140, similar to cover 110, is releasably and selectively mounted on housing 112, preventing unauthorized access to outlet 132 and to electrical plugs 116, which may be plugged into outlet 132. As shown, cover 140 is selectively locked in place on housing 112 through use of a lock 122, which is similar in structure to lock 22 of the embodiment of FIGS. 1–5.

As shown in FIG. 7, housing 112 is mounted to the wall surrounding the outlet 132 through use of the screws 134 conventionally provided with electrical outlets for holding the cover plate thereon. Here, the cover plate is removed and replaced with housing 112. It should be understood that the housing 112 may be mounted on the wall through the use of any suitable releasable fixtures. The housing 112 includes a rear plate 131, which may be spaced away from the wall, having an opening 130 formed therethrough, providing access to the outlets 132.

The sidewalls and upper wall of the housing 112 terminate in edge 114, as shown, for receiving cover 140. Cover 140 is positioned adjacent edge 114 and may be held thereto by frictional engagement therewith. Alternatively, a contoured lip may be formed on edge 114, such that cover 140 is slidably received in the upper portion of the housing 112 and held in place by the protruding lip. It should be understood, however, that cover 140 may be releasably secured to housing 112 through the use of any suitable releasable fixtures. Alternatively, cover 140 may be hinged, at the upper edge thereof, to the housing 112.

A rod 126, similar to the proximal end of rod 26 of FIGS. 1–5, is mounted on the lower edge of cover 140 and projects downwardly therefrom, as shown. A support 124, similar to support 24 of FIGS. 1–5, is mounted on the lower wall of housing 112 and projects downwardly therefrom. Support 124 has a channel 127 formed therein and extending downwardly in a substantially longitudinal direction.

Rod 126 is releasably received within channel 127 when cover 140 is mounted on housing 112. Support 124 is provided with at least one engaging member, similar to the embodiments of FIGS. 1–5, 9 and 10, and lock 122 releasably and selectively engages the at least one engaging member to partially cover support 124 and rod 126, releasably locking the cover 140 to the housing 112. As with the embodiments of FIGS. 1–5, 9 and 10, the lock 122 does not need to be fully removed from support 124 in order to disengage rod 126 from channel 127, the lock 122 may be held onto support 124 and selectively slid in the longitudinal direction in order to release rod 126. It should be further understood that FIG. 7 is a partially exploded view and that, in use, lock 122 partially covers both support 124 and rod 126. As noted above, lock 122 may be permanently secured to support 124 or may be releasable.

As with lock 22 of FIGS. 1–5, 9 and 10, the lock 122 is preferably a cylindrical combination lock. However, the choice of locking device is dependent upon the needs and desires of the user. Preferably, lock 122 has a user-changeable combination, allowing the user to set multiple locks 122 on multiple outlets in a household to the same combination, for convenience. It should be understood that, although shown as being applied to a conventional electrical outlet, locking device 100 may be used on electrical light switches, telephone relays or any other suitable electrical component for which the user wishes to control access.

Figure 8:
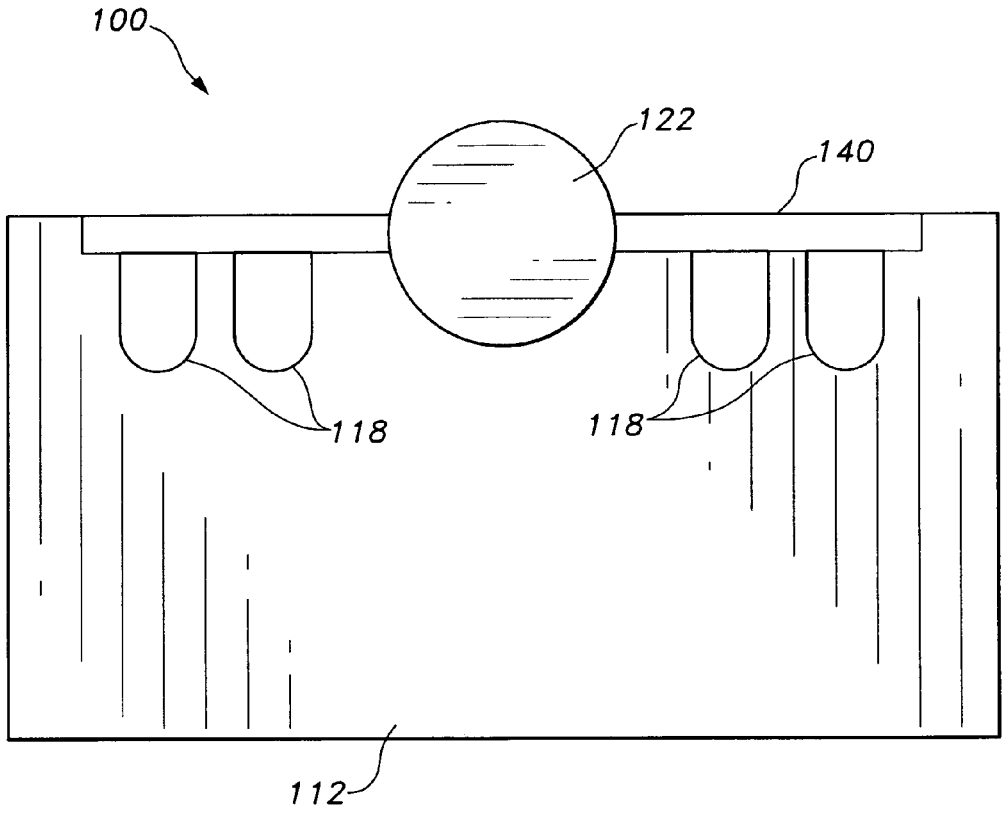
FIG. 8 is a bottom view of the locking device for electrical outlets of FIG. 6.

As shown in the bottom view of FIG. 8, the lower wall of housing 112 is provided with a plurality of openings 118. As shown in FIG. 6, the locking device 100 may be used when the electrical plugs 116 are plugged into outlets 132. Cover 140 is spaced apart from the outlets 132 so as to provide space for receiving plugs 116, and the cords associated with plugs 116 are received within openings 118. Though shown as having four openings 118, it should be understood that any desired number of openings 118 may be formed through the lower wall.

The use of locking device 100 not only prevents the accidental unplugging of electrical devices, but provides a safety device to prevent accidental electrocution caused by, for example, children accessing dangerous electrical outlets. Further, unauthorized unplugging of electrical devices may be prevented, and the user may further utilize the system 100 to prevent unauthorized electrical usage, thus deterring electrical theft.

Locking device 100 provides security against theft of electrical devices and appliances, and further provides protection against accidental injury and death that can occur from the unauthorized and accidental access to electrical plugs and outlets. Over 2.5 million children are injured or killed each year due to electrical accidents involving electrical outlets. Device 100 prevents the accidental access to electrical outlets 132 and further prevents the accidental unplugging of devices associated with outlets 132.

Locking device 100 is shaped and sized to replace the cover plate for outlets 132 or for an electrical switch plate. In addition to providing security for outlets and switches, the locking device 100 provides selective control and access to the electrical power source. For example, parents may control the video game or television habits of their children by selectively locking or unlocking access to the electrical outlet that powers the game or television. Further, unauthorized users may be prevented from stealing electricity through the locking of outlets 132 with device 100. Locking device 100 may be used with any suitable power source or switch assembly, such as telephone box, a cable television box or a light switch assembly. Since device 100 fits over outlets 132, the device may be used with any type of outlet, such as three-prong outlets, for example, without interfering with the engaging of plugs therewith.

It is to be understood that the present invention is not limited to the embodiment described above, but encompasses any and all embodiments within the scope of the following claims.

I claim:

1. A locking device for electrical plugs, comprising:

a housing having opposed upper and lower walls, longitudinally opposed front and rear walls, and a pair of opposed sidewalls, an upper opening being formed through the upper wall and extending in the longitudinal direction, the housing having an open interior region defined therein;

a support mounted on an exterior face of the front wall and projecting outwardly therefrom along the longitudinal direction, the support having an upper surface and a lower surface, the upper surface having a channel defined therein, the channel extending in the longitudinal direction, a front opening being formed in the front wall and extending between the channel and the upper opening;

at least one engagement member formed on the lower surface of the support and projecting downwardly therefrom;

a rod having a proximal end and a distal end, the distal end being pivotally secured to an inner face of the rear wall, the proximal end being removably received within the channel; and a lock selectively and releasably mounted on the support.

2. The locking device for electrical plugs as recited in claim 1, wherein said lock comprises a cylindrical combination tumbler lock.

3. The locking device for electrical plugs as recited in claim 1, further comprising user-selectable indicia imprinted on said housing.

4. The locking device for electrical plugs as recited in claim 1, further comprising a cover releasably secured to said housing and selectively covering the upper opening.

5. The locking device for electrical plugs as recited in claim 4, wherein said cover extends beyond said front wall in the longitudinal direction, said cover having an access opening formed therethrough, the access opening being positioned above said lock for providing the user with access to said lock.

6. A locking device for an electrical outlet, comprising:

a housing adapted for mounting on an electrical outlet, the housing having opposed upper and lower walls, a pair of opposed sidewalls, an open front portion and a rear wall, the rear wall having an opening formed therethrough for providing access to the electrical outlet;

a support mounted on an exterior face of the housing and projecting therefrom in a substantially longitudinal direction, the support having an upper surface and a lower surface, the upper surface having a channel defined therein, the channel extending in the longitudinal direction;

at least one engagement member formed on the lower surface of the support and projecting outwardly therefrom;

a cover releasably mounted on the housing, the cover selectively and releasably covering the open front portion;

an engaging rod mounted on an edge of the cover and extending therefrom along the longitudinal direction, the engaging rod being releasably received within the channel of the support; and a lock selectively and releasably mounted on the support;

whereby, when the cover selectively and releasably covers the open front portion of the housing, the rod is received within the channel of the support and the support and the rod are selectively and releasably covered by the lock, the lock engaging the at least one engagement member to releasably lock the rod to the support and the cover to the housing, the electrical outlet being covered 21 by the cover with access being provided through selective disengagement of the lock.

7. The locking device for an electrical outlet as recited in claim 6, wherein at least one passage is formed through said lower wall adapted for receiving a cord of an electrical plug therethrough.

8. The locking device for an electrical outlet as recited in claim 6, wherein front edges of said pair of sidewalls and said upper wall terminate in a rim for slidably receiving and engaging said cover.

9. The locking device for an electrical outlet as recited in claim 6, wherein said rear wall has at least one fastener opening formed therethrough for receiving a fastener associated with the electrical outlet for selectively and releasably securing said housing to the electrical outlet.

10. The locking device for electrical plugs as recited in claim 6, wherein said lock comprises a cylindrical combination tumbler lock.

11. The locking device for electrical plugs as recited in claim 6, further comprising user-selectable indicia imprinted on said housing.

12. A locking device, comprising:

a housing having opposed upper and lower walls, a pair of opposed sidewalls, an open front portion and a rear wall;

a support mounted on an exterior face of the housing and projecting outwardly therefrom, said support extending in a longitudinal direction, the support having an upper surface and a lower surface, the upper surface having a channel defined therein, the channel extending in the longitudinal direction;

at least one engagement member formed on the lower surface of the support and projecting outwardly therefrom;

a cover releasably mounted on the housing, the cover selectively and releasably covering the open front portion;

an engaging rod mounted on a first edge of the cover and extending outwardly along the longitudinal direction, the engaging rod being releasably received within the channel of the support; and a lock selectively and releasably mounted on the support;

whereby, when the cover selectively and releasably covers the open front portion of the housing, the rod is received within the channel of the support and the support and the rod are selectively and releasably covered by the lock, the lock engaging the at least one engagement member to releasably lock the rod to the support and the cover to the housing.

* * * * *